US010514181B2

(12) United States Patent
Chappell et al.

(10) Patent No.: US 10,514,181 B2
(45) Date of Patent: Dec. 24, 2019

(54) COUNTERWEIGHTED BACKDRAFT DAMPER BLADE WITH IMPROVED AIRFLOW PROFILE

(71) Applicant: T.A. Morrison & Co. Inc., Stittsville, Ontario (CA)

(72) Inventors: Ronald Chappell, Stittsville (CA); Stephen Dane Carey, LaVergne, TN (US)

(73) Assignee: T.A. Morrison & Co. Inc., Stittsville, Ontario, ON (CA)

( * ) Notice: Subject to any disclaimer, the term of this patent is extended or adjusted under 35 U.S.C. 154(b) by 0 days.

(21) Appl. No.: 14/641,632

(22) Filed: Mar. 9, 2015

(65) Prior Publication Data

US 2016/0265806 A1 Sep. 15, 2016

(51) Int. Cl.

| | |
|---|---|
| ***F24F 7/00*** | (2006.01) |
| ***F24F 13/14*** | (2006.01) |
| ***F24F 13/15*** | (2006.01) |

(52) U.S. Cl.

CPC ..... *F24F 13/1426* (2013.01); *F24F 13/1413* (2013.01); *F24F 13/15* (2013.01); *F24F 2013/1466* (2013.01)

(58) Field of Classification Search

CPC ..... F24F 13/1426; F24F 13/1416; F24F 2013/1466

USPC ..... 454/259

See application file for complete search history.

(56) References Cited

U.S. PATENT DOCUMENTS

| | | | | |
|---|---|---|---|---|
| 718,657 | A | 1/1903 | Renton | |
| 2,186,354 | A | 1/1940 | Whetstine | |
| 2,840,317 | A | 6/1958 | Kozak | |
| 3,204,548 | A * | 9/1965 | McCabe | F24F 13/15 454/352 |
| 3,982,560 | A | 9/1976 | Dibert | |
| 4,384,672 | A | 5/1983 | Kutzner et al. | |
| 4,494,564 | A | 1/1985 | Lukacz | |
| 4,655,122 | A * | 4/1987 | McCabe | F24F 13/15 137/512.1 |
| 5,277,658 | A * | 1/1994 | Goettl | F24F 11/043 137/512.1 |

(Continued)

*Primary Examiner* — Helena Kosanovic

(74) *Attorney, Agent, or Firm* — Sughrue Mion, PLLC

(57) ABSTRACT

A backdraft damper for permitting a flow of air in an outflow direction and preventing the flow of air in a backdraft direction has a frame provided with a transverse opening allowing the passage of air through the frame. One or more blades extend across the frame and are mounted to the frame about a central portion by pivot members, for rotation between open and closed positions. Each blade comprises a blade body having a leading portion upstream of the central portion, the leading portion of the blade body comprising a channel, a trailing portion downstream of the central portion, the trailing portion of the blade having a larger surface area than the leading portion and comprising a seal disposed adjacent to a distal edge of the trailing portion, for sealing against either the leading portion of an adjacent blade or a blade stop projecting from the frame, and a counterweight disposed in the channel, whereby the counterweight balances the blade such that the blade is biased to the closed position by gravity and movable to the open position by the force of air flowing through the frame in the outflow direction.

20 Claims, 5 Drawing Sheets

(56) References Cited

U.S. PATENT DOCUMENTS 5,732,507 A * 3/1998 Edwards ..... E04B 7/163
49/74.1
6,435,962 B1 * 8/2002 Herron ..... F24F 13/1413
454/290

* cited by examiner

COUNTERWEIGHTED BACKDRAFT DAMPER BLADE WITH IMPROVED AIRFLOW PROFILE

FIELD OF THE INVENTION

This invention relates to airflow dampers. In particular the invention relates to backdraft dampers.

BACKGROUND OF THE INVENTION

Backdraft dampers are used to prevent the backdraft of air in various industrial and commercial heating, ventilating and air conditioning (HVAC) systems.

Such dampers typically comprise an outer frame sized to either fit into a specified opening or to cover a specific opening, in various environments. The damper blades are movable from an open position in which air is permitted to flow through the damper frame in one direction, and a closed position blocking the flow of air through the damper frame in the other direction, in order to prevent the contamination of air within a premises and/or the ingress of thermally unfavourable air (warm or cold) into a thermally controlled premises.

A backdraft damper must work automatically under the force of air, flowing either in the intended (outflow) direction, in which the airflow maintains the backdraft blades in an open condition, or in the reverse (backdraft) direction in which the loss of outflow air causes the backdraft blades to move to the closed position under the influence of gravity, and the backdraft maintains the blades in the closed position for the duration of the backdraft current. In order to ensure this, the blades must be biased to the closed position by gravity. However, this means that some of the force of the air flowing in the outflow direction is always sacrificed in order to maintain the damper blades in the open position, which reduces the airflow of the outflow current. HVAC systems are typically carefully designed to distribute air evenly about a premises, and this reduction in airflow can have the effect of skewing the pressure distribution to some flow-paths over others, reducing the intended airflow rates to some parts of the premises.

One solution to this is to try and balance the blades about their respective pivot rods so that little force is required to open them. However, this can cause inadvertent leakage in the backdraft direction, resulting in lower efficiency where the backdraft damper is providing thermal protection, and in situations where the backdraft damper is preventing the potential ingress of toxic or noxious gasses can result in a serious risk to occupants of the premises.

It would accordingly be advantageous to provide a backdraft damper having blades which are biased to the closed position with sufficient force to prevent the blades from remaining open when the outflow current is disrupted, but which can be opened with a relatively low force without impeding the airflow through the damper and thus without losing pressure to maintaining the damper in the open position.

BRIEF DESCRIPTION OF THE DRAWINGS

In drawings which illustrate by way of example only a preferred embodiment of the invention.

DETAILED DESCRIPTION OF THE INVENTION

The invention provides a heavy duty backdraft blade 30. The blade 30 may for example be extruded from aluminium, having a thickness which imparts strength and rigidity. The blade 30 is counterweighted, balancing the blade 30 so that it readily pivots to the open position under the influence of an airflow in the output direction, and pivots to the closed position under the influence of gravity when the airflow ceases.

In the preferred embodiment the leading edge of the blade 30 has a bull nosed profile, which helps to un-restrict air flow across the blade profile, described in detail below. Also, in the preferred embodiment the downstream portion of the blade 30 has a trough-like feature designed to capture the air flow by creating a static head in the trough, which enables the blade 30 to smooth out the air flow while maintaining a 90 degree opening position in order to maximize the transverse opening through the damper frame.

Figure 5:
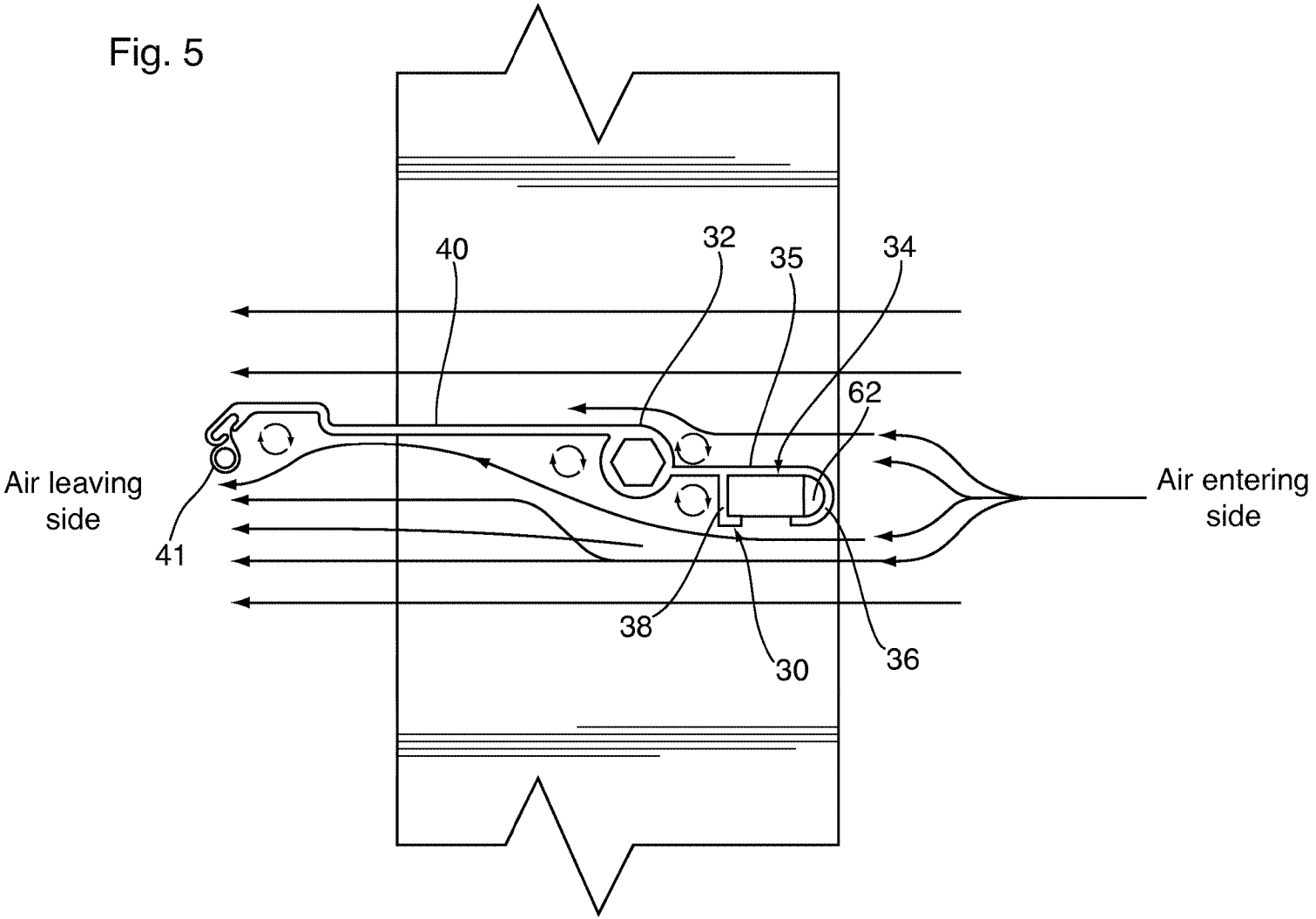
FIG. 5 is a schematic side elevation showing the characteristic profile of air flowing through the damper in the outflow direction.

The invention thus provides a backdraft damper 10 for permitting a flow of air in an outflow direction, shown by the arrows in FIG. 5, and preventing the flow of air in the opposite (backdraft) direction. A damper 10 according to the invention may be mounted in many different environments, for example to the wall of a plenum or HVAC unit, to a duct or to the outlet of a blower as indicated above, and the invention is not limited to any specific environment or application. Also, while the embodiment of the damper illustrated has five blades, the invention may be advantageously implemented in any backdraft damper 10 having one or more blades.

The damper 10 illustrated comprises a generally rectangular frame 12. The frame 12 comprises opposed sides 14, 16 respectively providing opposed mounting flanges 14*a*, 16*a* projecting outwardly, generally in a plane containing the respective front and rear faces 22, 24 of the damper 10. The frame sides 14, 16 are affixed to opposed ends 18, 20, each similarly comprising mounting flanges 18*a*, 20*a*, and having blade stops 26, 28 and extending laterally across the respective end 18, 20 of the frame for the purposes described below. The sides 14, 16 may be extruded from any suitable material so as to produce a rigid frame 12 that is not subject to substantial deformation when the damper 20 is in use, for example 0.05" to 0.25" (1.27 mm to 6.25 mm) aluminium or steel, and joined to the ends 18, 20 of the damper 10 by welding, fasteners (such as metal screws or rivets) or by any other suitable securing means.

The interior of the frame 12 thus defines a transverse opening allowing the passage of air through the frame 12, creating an airflow region extending between the inflow and outflow faces 22, 24. The airflow region is bounded by the side panels 14, 16 and the end panels 18, 20, and thus has a cross-section defined by the open area of the faces 22, 24. The blades 30 extend across and are mounted to the frame 12 in the manner described below.

Figure 1:
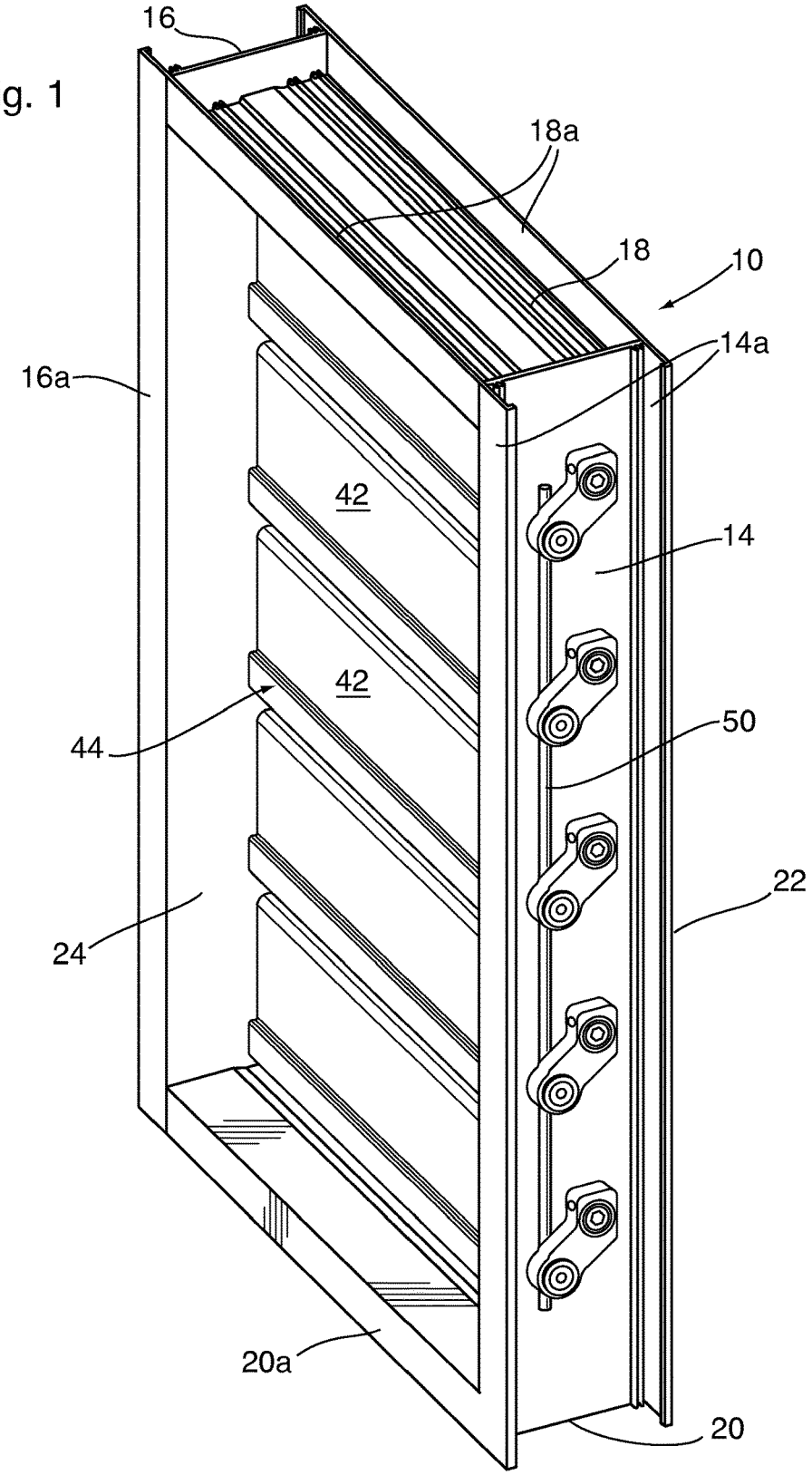
FIG. 1 is a perspective view of a backdraft damper according to the invention.
Figure 2:
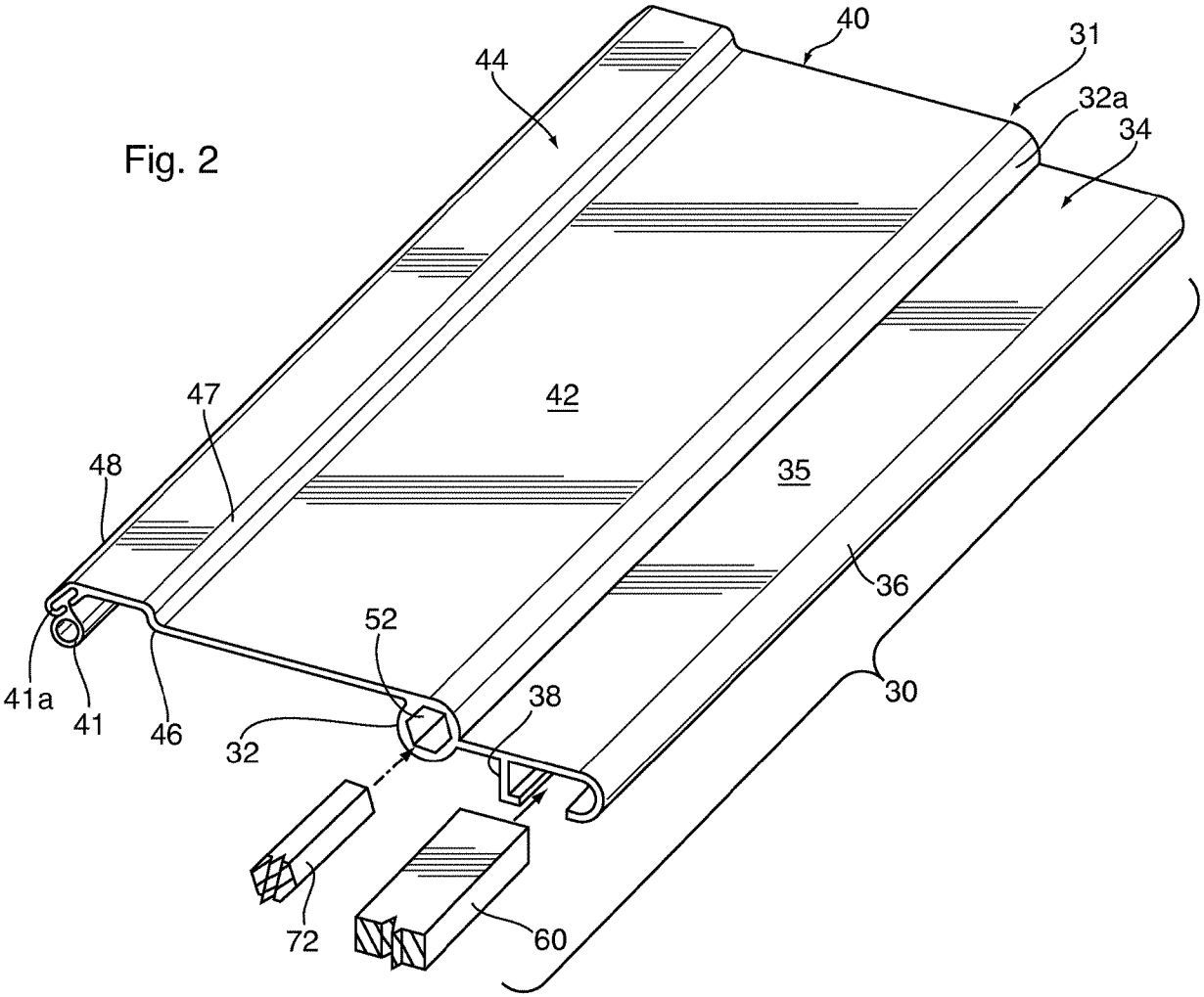
FIG. 2 is a perspective view of a damper blade in the backdraft damper of FIG. 1.
Figure 2A:
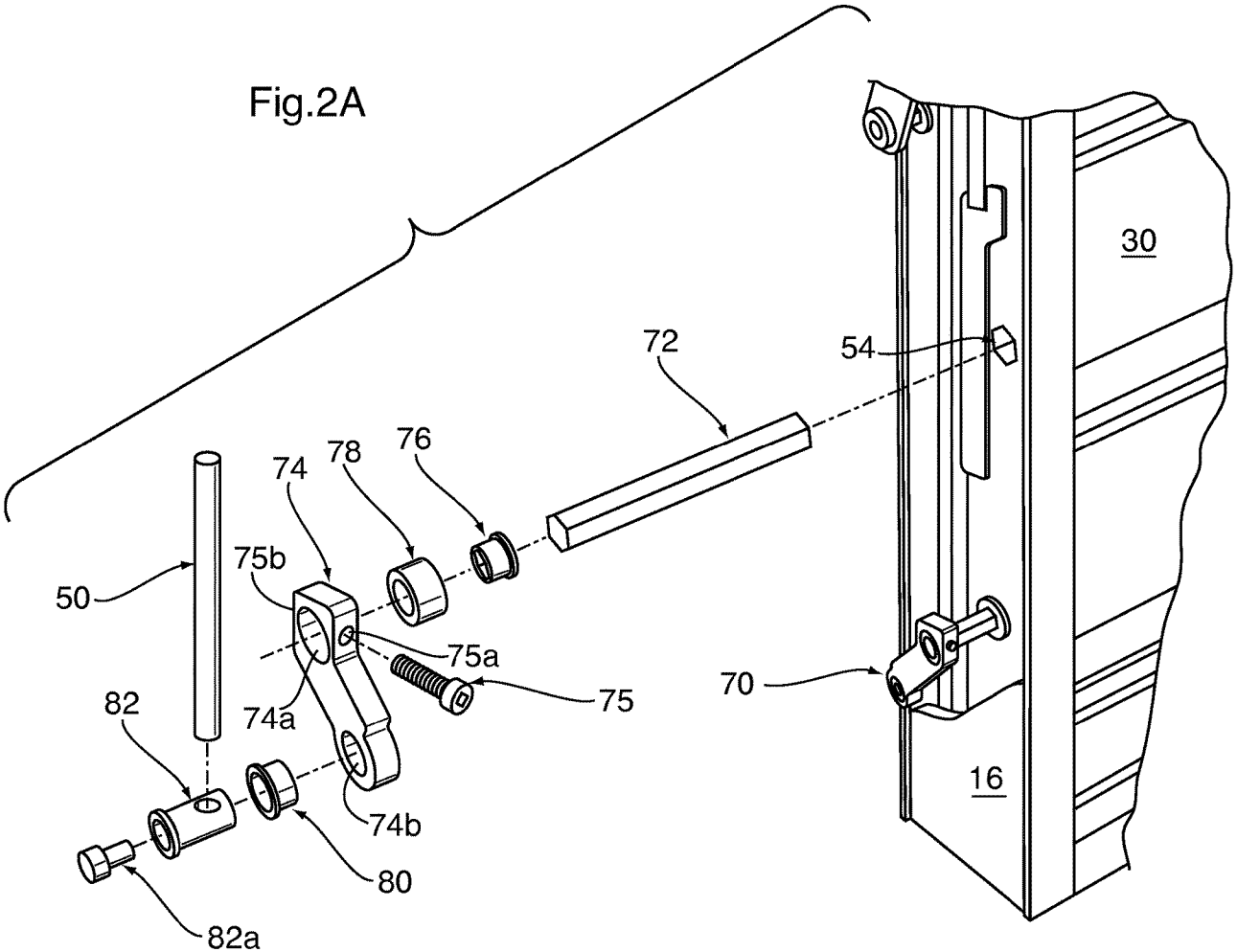
FIG. 2A is an exploded view of an embodiment of a crank arm linkage for the damper blade of FIG. 2.

Each blade 30 comprises a blade body 31 having central portion 32 for connection to a linkage rod 50 via crank arm linkage assembly 70, illustrated in FIG. 2A, for example formed from extruded aluminium components. The crank arm linkage assembly 70 comprises a pivot pin 72 for insertion in press-fit engagement into a pin channel 52 formed in the central portion 32, to rotationally lock the pivot pin 72 and the blade 30. For example, the pivot pin 72 is hexagonal in the embodiment illustrated, and the pin channel 52 is formed with a complementary hexagonal profile to receive the pivot pin 72 in rotationally locked engagement.

In the preferred embodiment the pivot pin 72 is mounted via a dual bearing system, comprising a durable polymer proximal bearing 76, for example formed from a polyacetyl polymer such as Celcon (trademark), disposed over the portion of the pivot pin 72 projecting from the pin channel 52 and having a circular external profile. The proximal bearing 76 is capped by a polycarbonate medial bearing 78 having a circular internal profile for slip-fit engagement over the proximal bearing 76, which permits free rotation between the proximal and medial bearings 76, 78. The proximal and medial bearings 76, 78 are disposed between the ends of the blade 30 and the sides 14, 16 of the frame and the pivot pin 72 extends beyond the proximal and medial bearings 76, 78 into a first opening 74*a* in the crank arm 74, as best seen in FIG. 2A. The first opening 74*a* has a profile complementary hexagonal profile of the pivot pin 72, to receive the pivot pin 72 in rotationally locked engagement, which is secured in the first opening 74*a* by fastener 75 which clamps arms 75*a* and 75*b* together to close the opening 74*a* and trap the end of the pivot pin 72.

A durable polymer distal bearing 80, which may also be formed from a polyacetyl polymer such as Celcon (trademark), has a circular exterior profile for engagement in a second opening 74*b* in the crank arm 74, spaced from the first opening. The second opening has a circular profile for slip-fit engagement by the distal bearing 80. The internal profile of the distal bearing 80 is also circular, for receiving a trunnion bearing 82 through which the linkage rod 50 extends and is axially fixed by cup point fastener 82*a*. The medial bearing 78 is preferably fixed in the damper frame 16 via a hexagonal shaped hole. The pivot pin 72 is placed through the bearings 76 and 78 and then located into the first crank arm opening 74 a by a fastener 75.

Figure 3:
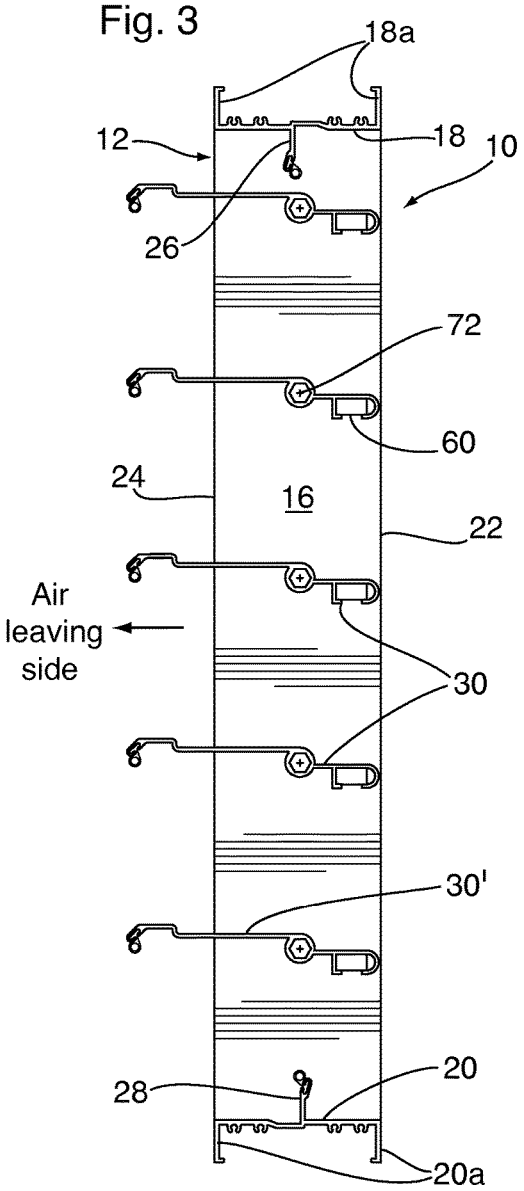
FIG. 3 is a cross-sectional side elevation of the backdraft damper of FIG. 1 in the open position.
Figure 4:
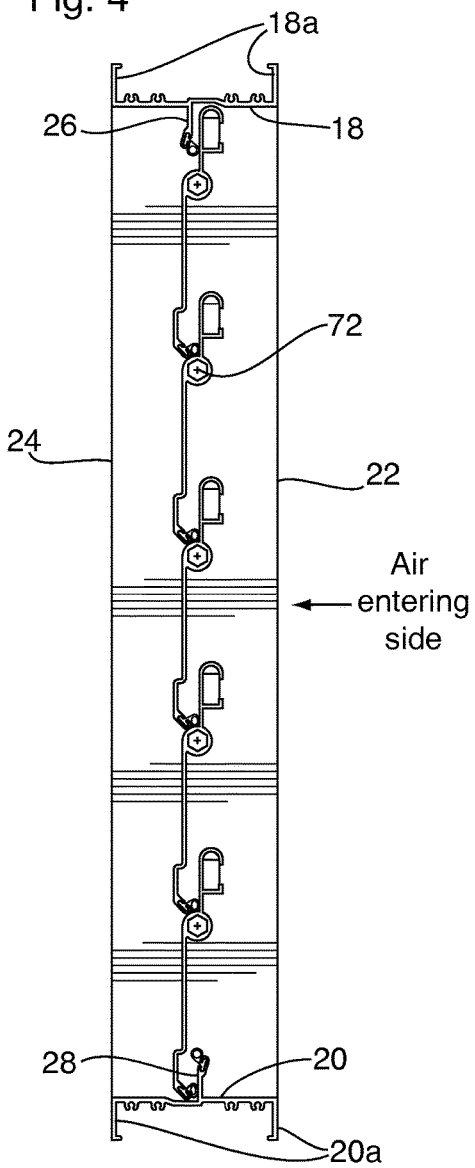
FIG. 4 is a cross-sectional side elevation of the backdraft damper of FIG. 1 in the closed position.

Thus, when mounted to the frame 12 each blade 30 can rotate between an open position in which the blade 30 allows air to flow through the frame 12, as illustrated in FIG. 3, and a closed position in which the blade 30 impedes air from flowing through the frame 12, as illustrated in FIG. 4. However, it will be appreciated that the blades 30 merely need to be pivotable between the opened and closed positions, so the rotational locking of the pivot pin 72 to the pin channel 52 is optional (but may assist in reducing noise and/or wear on the blade 30).

The blade body 31 further comprises a leading portion 34 upstream of the central portion 32 (relative to the outflow direction of the damper 10). The leading portion 34 of the blade body 31 comprises a planar section 35 merging into the wall of a channel 62 for receiving a counterweight 60. The counterweight 60 may for example be formed from steel or another suitably heavy material.

In the preferred embodiment the leading edge 36 of the leading portion 34 is rounded, forming a bullnose profile that reduces the formation of eddies and currents as the air flows past the blade 30. Thus, the part of the leading portion 34 forming the leading face of the channel 62 for the counterweight 60 can be formed as a bullnose. This diminishes friction and thus resistance to the airflow, in turn reducing the pressure and velocity required for operation and pressure losses downstream of the damper 10. The other side of the channel 62 may be formed by a generally "L"-shaped flange 38 depending from the planar section 35 of the leading portion 34. These features are readily formed by extrusion, and allow the counterweight 60 to be inserted into the blade body 31 from the side.

In preferred embodiments the planar section 35 of the leading portion 34 is transversely offset from the axis of the pivot pin 72. This results in an arcuate occlusion at the central portion 32 which allows for the formation of a static head upstream of the central portion 32 both above and below the planar section 35 of the leading portion 34 of the blade 30, as shown in FIG. 5. The static head acts to smooth out the airflow above the blade 30 in the open position, reducing resistance to the airflow and thus reducing pressure losses downstream of the damper 10.

The blade body 31 further comprises a trailing portion 40 downstream of the central portion 32. The trailing portion 40 of the blade body 31 provides a seal 41, for example a silicone bubble gasket having a spline lodged (for example crimped) in a slot 41*a* extending across the distal edge of the trailing portion 40. The seal 41 seals against either the planar section 35 of the leading portion 34 of an adjacent blade 30 or, in the case of the lowest blade 30', against the blade stop 28 projecting from the bottom end 20 of the frame 12, to prevent backflow in the closed position shown in FIG. 4. The stronger the backflow the more pressure is exerted against the trailing portion 40, which has a significantly larger surface area than the leading portion 34, increasing the effect of the seal 41.

The heavier the counterweight 60, the closer the counterweight 60 may be disposed to the pivot pin 52 in order to properly balance the blade 30 to be slightly gravitationally biased to the closed position shown in FIG. 4. This keeps the surface area of the leading portion 34 small relative to the surface area of the trailing portion 40, which both reduces the pressure required to pivot the blades 30 to the open position shown in FIG. 3 and ensures that a backdraft airflow forces the blades 30 more tightly into the closed position, rather than toward the open position.

The trailing portion 40 is similarly preferably transversely offset from the axis of the pivot pin 72, on the opposite side of the pivot pin 72 from the leading portion, which allows for the formation of a static head immediately downstream of the central portion 32 of the blade 30. The trailing portion 40 is preferably provided with a generally planar portion 42 extending from the central portion 32, and a lateral depression 44 open opposite to the direction of the offset of the trailing portion 40 from the central portion 32, adjacent to the distal edge of the trailing portion 40. The lateral depression 44 may be formed essentially as a return flange, for example by upward bend 46, downstream bend 47 and downward bend 48.

The lateral depression 44 allows for the creation of a static head below the trailing portion 40, as shown in FIG. 5. Similar to the upstream static head formed by the surface 32*a* of the central portion 32, which acts to smooth out the airflow above the blade 30, this downstream static head acts to smooth out the airflow below the blade 30 in the open position, reducing resistance to the airflow and thus reducing pressure losses downstream of the damper 10. The downstream static head formed beneath the lateral depression 44 also provides a buffer zone beneath the lateral depression 44 that helps to keep the blade 30 in the fully open position when air is flowing through the frame 12.

In operation, the damper 10 is mounted vertically into a structure with the leading portions 34 of the blades 30 at the top in the closed position shown in FIG. 4, which is the rest position of the blades under the influence of gravity without any airflow. When air starts to flow in the desired direction, shown by the arrows in FIG. 5, a uniform downstream pressure is exerted against the blades, but because the surface area of the trailing portion 40 is much larger than the surface area of the leading portion 34, the greater force of the airflow against the trailing portion 40 overcomes the influence of gravity and forces the blades 30 to pivot to the open position shown in FIG. 3.

As each blade 30 pivots the rotational interlock between the pin channel 54 and the pivot pin 72 rotates the crank arm 74, which moves the linkage rod 50, causing all blades 30 to pivot in synchronization to open the damper 10 uniformly across its full cross-section.

When the airflow stops, the blades return to the closed position illustrated in FIG. 4 under the influence of gravity, also in synchronization. The combination of the distance of the counterweight 60 from the fulcrum provided by the pivot pin 72, and the weight of the counterweight 60, is selected to so as to maintain a slight bias toward the closed position while allowing the airflow to overcome the influence of gravity at relatively low pressures.

Thus, absent any airflow and solely under the influence of gravity the trailing portion 40 has greater torque than the leading portion 34, but a slight airflow in the desired (downstream) direction is sufficient to overcome this differential. In the event of a backdraft airflow, the force of the backdraft against the trailing portion 40 due to its larger surface area is greater than the force against the leading portion 34, but in the case of a backdraft this force is additive to the gravitational biasing force and thus increases the bias to the closed position, and increases the efficacy of the seals 41.

The static heads formed at the central portion 32 and beneath the lateral depression 44 reduce friction and allow for a smoother flow of air past the blade bodies 31. The double bends forming the lateral depression 44 and the bullnose formation about the counterweight both also serve to impart additional strength and rigidity to the blade body 31.

Various embodiments of the present invention having been thus described in detail by way of example, it will be apparent to those skilled in the art that variations and modifications may be made without departing from the invention. The invention includes all such variations and modifications as fall within the scope of the appended claims.

The invention claimed is:

1. A backdraft damper for permitting a flow of air in an outflow direction and preventing the flow of air in a backdraft direction, comprising:

a frame having a transverse opening allowing the passage of air through the frame, at least one blade extending across the frame and mounted to the frame about a central portion by pivot pin, for rotation about a pivot axis of the pivot pin between an open position in which the at least one blade allows air to flow through the frame and a closed position in which the at least one blade blocks air from flowing through the frame, the blade comprising a blade body having:

a leading portion comprising a lead planar section extending from the central portion in a first direction and a channel extending axially, the lead planar section being offset on a first side of the pivot axis in a transverse direction that is generally orthogonal to the first direction at least a portion of the central portion extending beyond the lead planer section in the transverse direction, a trailing portion comprising a trailing planar section extending from the central portion in an opposing second direction, the trailing planar section being substantially parallel to the lead planar section and being offset on a second side of the pivot axis in the transverse direction, the trailing portion of the blade having a larger surface area than the leading portion and comprising a seal disposed adjacent to a distal edge of the trailing portion, for sealing against either the leading portion of an adjacent blade or a blade stop projecting from the frame, the lead planar section terminating at the central portion of the blade in an arcuate occlusion adjacent a first surface of the lead planar section which merges into the trailing planar section and allows for the formation of a static head of air upstream of the central portion, such that when air is flowing through the frame a first static head of air is formed between an exposed upstream facing surface of the central portion and the first surface of the lead planar section, and a counterweight disposed in the channel, whereby the counterweight balances the blade such that the blade is biased to the closed position by gravity and movable to the open position by the force of air flowing through the frame in the outflow direction.

2. The backdraft damper of claim 1 comprising a plurality of blades.

3. The backdraft damper of claim 2 wherein the channel is formed along an upstream, distal edge of the lead planar section.

4. The backdraft damper of claim 3 wherein the channel comprises an outer surface having a rounded profile.

5. The backdraft damper of claim 4 wherein the upstream surface of the central portion is arcuate.

6. The backdraft damper of claim 4 wherein a downstream section of the trailing portion spaced from the central portion is provided with a transversely extending depression, whereby when air is flowing through the frame a second static head of air is formed beneath the depression.

7. The backdraft damper of claim 6 wherein the seal is disposed along a downstream, distal end of the lateral depression, whereby the second static head of air formed beneath the depression is disposed between the seal and the trailing planar section.

8. A blade for mounting to a backdraft damper for permitting a flow of air in an outflow direction and preventing the flow of air in a backdraft direction comprising a frame having a transverse opening allowing the passage of air through the frame, the blade extending across the frame for rotation about the pivot axis between an open position in which the blade allows air to flow through the frame and a closed position in which the blade blocks air from flowing through the frame, the blade comprising:

a blade body having a leading portion comprising a lead planar section extending from the central portion in a first direction and a channel extending axially, the lead planar section being offset on a first side of the pivot axis in a transverse direction that is generally orthogonal to the first direction at least a portion of the central portion extending beyond the lead planar section in the transverse direction, a trailing portion comprising a trailing planar section extending from the central portion in an opposing second direction, the trailing planar section being substantially parallel to the lead planar section and being offset on a second side of the pivot axis in the transverse direction, the trailing planar section of the blade having a larger surface area than the lead planar section and comprising a seal disposed adjacent to a distal edge of the trailing portion, the lead planar section terminating at the central portion of the blade in an arcuate occlusion which merges into the trailing planar section and allows for the formation of a static head of air upstream of the central portion, such that when air is flowing through the frame a first static head of air is formed between an exposed upstream surface of the central portion and the leading portion of the blade, and a counterweight disposed in the channel, whereby the counterweight balances the blade such that the blade is biased to the closed position by gravity and movable to the open position by the force of air flowing through the frame in the outflow direction.

9. The blade of claim 8 wherein a downstream section of the trailing portion downstream from the trailing planar section is provided with a lateral depression, whereby when air is flowing through the frame a static head of air is formed beneath the depression.

10. A backdraft damper for permitting a flow of air in an outflow direction and preventing the flow of air in a backdraft direction, comprising:

a frame having a transverse opening allowing the passage of air through the frame, at least one blade extending across the frame and mounted to the frame about a central portion by pivot pin, for rotation about a pivot axis of the pivot pin between an open position in which the at least one blade allows air to flow through the frame and a closed position in which the at least one blade blocks air from flowing through the frame, the blade comprising a blade body having a blade body having a leading portion comprising a lead planar section extending from the central portion in a first direction and a channel extending axially, the lead planar section being offset on a first side of the pivot axis in a transverse direction that is generally orthogonal to an upstream direction at least a portion of the central portion extending beyond the lead planar section in the transverse direction, a trailing portion comprising a trailing planar section extending from the central portion in an opposing, second direction, the trailing planar section being substantially parallel to the lead planar section and being offset on a second side of the pivot axis in the transverse direction and the trailing portion of the blade having a larger surface area than the leading portion and comprising a seal disposed adjacent to a distal edge of the trailing portion, for sealing against either the leading portion of an adjacent blade or a blade stop projecting from the frame, a section of the trailing portion downstream from the trailing planar section being provided with a depression spaced from the central portion and extending generally axially along a length of the blade, the depression comprising a return flange comprising upward bend, a downstream bend and a downward bend such that when air is flowing through the frame a static head of air is formed beneath the depression when the blade is in the open position, and a counterweight disposed in the channel, whereby the counterweight balances the blade such that the blade is biased to the closed position by gravity and movable to the open position by the force of air flowing through the frame in the outflow direction.

11. The backdraft damper of claim 10 comprising a plurality of blades.

12. The backdraft damper of claim 11 wherein the channel is formed along an upstream, distal edge of the leading portion of the blade.

13. The backdraft damper of claim 12 wherein the channel comprises an outer surface having a rounded profile.

14. The backdraft damper of claim 13 wherein when air is flowing through the frame a second static head of air is formed between an exposed upstream facing surface of the central portion and the lead planar section of the blade.

15. The backdraft damper of claim 14 wherein the upstream facing surface of the central portion is arcuate.

16. The backdraft damper of claim 11 wherein the trailing portion is transversely offset from the axis of the pivot pin.

17. The backdraft damper of claim 14 wherein the trailing portion is transversely offset from the axis of the pivot pin on a side of the pivot pin opposite the offset of the leading portion.

18. The backdraft damper of claim 17 wherein the seal is disposed along a distal end of the lateral depression.

19. The backdraft damper of claim 4, wherein channel is offset outwardly from the lead planar section in the transverse direction whereby the counterweight is disposed on the first side of the pivot axis and wherein the seal is disposed on the opposing second side of the pivot axis.

20. The backdraft damper of claim 4, wherein a downstream side of the channel comprises a flange extending transversely away from the lead planar section on the first side of the pivot axis and configured to provide a second occlusion adjacent an opposing, second side of the lead planar section and allows for the formation of a static head of air upstream of the central portion, such that when air is flowing through the frame a third static head of air is formed between an exposed upstream facing surface of the central portion and the second surface of the lead planar section.

* * * * *